US009922763B2

(12) United States Patent
Chen et al.

(10) Patent No.: US 9,922,763 B2
(45) Date of Patent: Mar. 20, 2018

(54) TRANSFORMER WITH TWO TRANSFORMATION RATIO

(71) Applicant: MediaTek Singapore Pte. Ltd., Singapore (SG)

(72) Inventors: Yangjian Chen, Kent (GB); Bernard Mark Tenbroek, Kent (GB)

(73) Assignee: MEDIATEK SINGAPORE PTE. LTD., Fusionopolis Walk (SG)

( * ) Notice: Subject to any disclaimer, the term of this patent is extended or adjusted under 35 U.S.C. 154(b) by 86 days.

(21) Appl. No.: 14/923,479

(22) Filed: Oct. 27, 2015

(65) Prior Publication Data

US 2016/0118180 A1 Apr. 28, 2016

Related U.S. Application Data

(60) Provisional application No. 62/069,499, filed on Oct. 28, 2014.

(51) Int. Cl.
*H01F 21/12* (2006.01)
*H01F 27/28* (2006.01)

(52) U.S. Cl.
CPC ..... *H01F 27/2804* (2013.01); *H01F 21/12* (2013.01); *H01F 2021/125* (2013.01); *H01F 2027/2819* (2013.01)

(58) Field of Classification Search
CPC ..... H01F 2027/2809; H01F 27/2823; H01F 27/2804; H01F 17/0013; H01F 19/04
See application file for complete search history.

(56) References Cited

U.S. PATENT DOCUMENTS

| | | | | |
|---|---|---|---|---|
| 7,777,570 | B2 | 8/2010 | Lai | |
| 8,519,814 | B2 | 8/2013 | Feng et al. | |
| 2008/0024349 | A1* | 1/2008 | Bhagat | H01F 17/0006 341/155 |
| 2008/0094166 | A1* | 4/2008 | Hsu | H01F 27/2804 336/223 |
| 2010/0148866 | A1* | 6/2010 | Lee | H03F 1/3211 330/197 |
| 2012/0326826 | A1* | 12/2012 | Gertenbach | H01F 27/346 336/171 |
| 2013/0026846 | A1* | 1/2013 | Gianesello | H01F 27/2804 307/104 |

(Continued)

FOREIGN PATENT DOCUMENTS

TW 201342402 A 10/2013

OTHER PUBLICATIONS

SIPO Office Action dated Feb. 28, 2017 in Chinese application (No. 201510714233.2).

*Primary Examiner* — Elvin G Enad
*Assistant Examiner* — Malcolm Barnes
(74) *Attorney, Agent, or Firm* — McClure, Qualey & Rodack, LLP

(57) ABSTRACT

A transformer includes a first winding conductor and a second winding conductor, magnetically coupled to the first winding conductor. A first transformation ratio is achieved between the second winding conductor and the first winding conductor. A first distance between the first winding conductor and the second winding conductor is higher than a distance threshold, and accordingly, a first coupling factor between the first winding conductor and the second winding conductor is lower than a coupling factor threshold.

23 Claims, 6 Drawing Sheets

(56) References Cited

U.S. PATENT DOCUMENTS

| | | | | |
|---|---|---|---|---|
| 2013/0082810 | A1* | 4/2013 | Feng | H01F 27/2804 336/145 |
| 2013/0265132 | A1* | 10/2013 | Huang | H01F 27/2804 336/192 |
| 2014/0320230 | A1* | 10/2014 | Jooyaie | H01F 27/2804 333/25 |
| 2015/0310980 | A1* | 10/2015 | Yen | H01F 27/2804 336/200 |
| 2016/0027571 | A1* | 1/2016 | Zhang | H01F 27/2804 336/173 |

* cited by examiner

TRANSFORMER WITH TWO TRANSFORMATION RATIO

This application claims the benefit of U.S. provisional application Ser. No. 62/069,499, filed Oct. 28, 2014, the disclosure of which is incorporated by reference herein in its entirety.

TECHNICAL FIELD

The disclosure relates in general to a transformer having two largely different transformation ratios (TR).

BACKGROUND

Transformers are widely used in modern radio frequency (RF) transceiver design to control signal flow. There are many conventional ways to implement the transformer using metal conductors routed in an integrated circuit. For example, an on-chip transformer can be implemented using a one-side coplanar design, a two-side coplanar design, a broadside design, or a hybrid design. The impedance transformation is critical in RF transceiver design to improve power efficiency.

How to achieve the on-chip transformer having better coupling efficiency and less coupling loss is highly desired.

SUMMARY

The disclosure is directed to a transformer having two largely different transformation ratio (TR) wherein the transformer operated in a low coupling, high TR mode is used in low output power condition while the transformer operated in a high coupling, low TR mode is used in high output power condition.

According to one embodiment, a transformer is provided. The transformer includes a first winding conductor and a second winding conductor, magnetically coupled to the first winding conductor. A first transformation ratio is achieved between the second winding conductor and the first winding conductor. A first distance between the first winding conductor and the second winding conductor is higher than a distance threshold, and accordingly, a first coupling factor between the first winding conductor and the second winding conductor is lower than a coupling factor threshold.

According to another embodiment, a transformer is provided. The transformer includes a first winding conductor, routed in an inner part on a first metal layer of the transformer; a second winding conductor, magnetically coupled to the first winding conductor, routed in an outer part on a second metal layer of the transformer; and a third winding conductor, magnetically coupled to the second winding conductor, routed in an outer part on the first metal layer of the transformer. The second winding conductor and the third winding conductor are vertically stacked. A first transformation ratio is based on a first distance and an inductance ratio between the first and the second winding conductors. A second transformation ratio is based on a second distance and an inductance ratio between the third and the second winding conductors. The first transformation ratio is higher than the second transformation ratio.

According to yet another embodiment, a transformer is provided. A transformer includes: a first winding conductor; a second winding conductor, magnetically coupled to the first winding conductor; and a third winding conductor, magnetically coupled to the second winding conductor. A first coupling factor is achieved between the first and the second winding conductors. A second coupling factor, higher than the first coupling factor, is achieved between the second and the third winding conductors.

According to still another embodiment, a transformer is provided. A transformer includes: a first winding conductor; a second winding conductor, magnetically coupled to the first winding conductor; and a third winding conductor, magnetically coupled to the second winding conductor. A first coupling factor and a first transformation ratio are achieved between the first and the second winding conductors. A second coupling factor and a second transformation ratio are achieved between the second and the third winding conductors, the first coupling factor lower than the second coupling factor, the first transformation ratio higher than the second transformation ratio. An inductance of the first winding conductor is bigger than both inductances of the second and the third winding conductors, and a surrounding area of the first winding conductor is smaller than both surrounding areas of the second and the third winding conductors.

Figure 1:
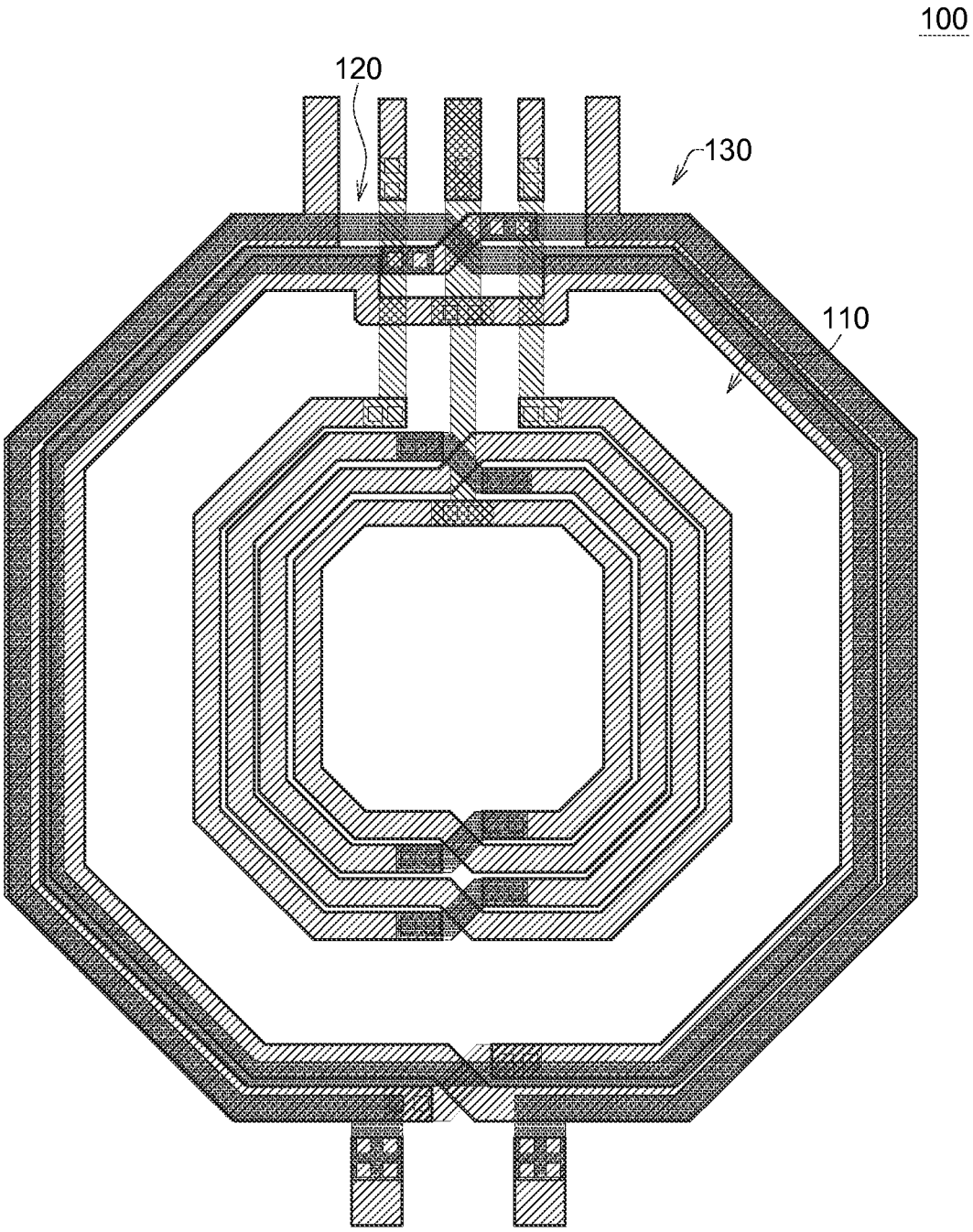
FIG. 1 shows a layout of a transformer having two different transformation ratios (TR) according to an embodiment of the application.

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

DETAILED DESCRIPTION

Technical terms of the disclosure are based on general definition in the technical field of the disclosure. If the disclosure describes or explains one or some terms, definition of the terms is based on the description or explanation of the disclosure.

Each of the disclosed embodiments has one or more technical features. In possible implementation, one skilled person in the art would selectively implement part or all technical features of any embodiment of the disclosure or selectively combine part or all technical features of the embodiments of the disclosure.

In the following, the term "couple" is intended to mean either an indirect or a direct electrical connection. Thus, if a first device is coupled to a second device, that connection may be through a direct electrical connection, or through an indirect electrical connection via other devices and connections.

As is well known, transformers include a primary winding and a secondary winding. A current coming into the primary winding induces a magnetic field that, in turn, generates the current so that power is transferred from the primary winding to the secondary winding. The relationship between the voltage/current input to the primary winding and the voltage/current output by the secondary winding is defined by the transformation ratio (TR) of the transformer.

FIG. 1 shows a layout of a transformer having two different transformation ratios (TR) according to an embodiment of the application. As shown in FIG. 1, the transformer 100 includes a first winding conductor 110, a second winding conductor 120 and a third winding conductor 130.

The first winding conductor 110 and the third winding conductor 130 are routed on the same metal layer (i.e. the first winding conductor 110 and the third winding conductor 130 are lateral), while the second winding conductor 120 is routed on another metal layer. In other possible embodiments of the application, the first winding conductor 110 and the third winding conductor 130 are stacked. Details of the first winding conductor 110, the second winding conductor 120 and the third winding conductor 130 are as follows.

Figure 2A:
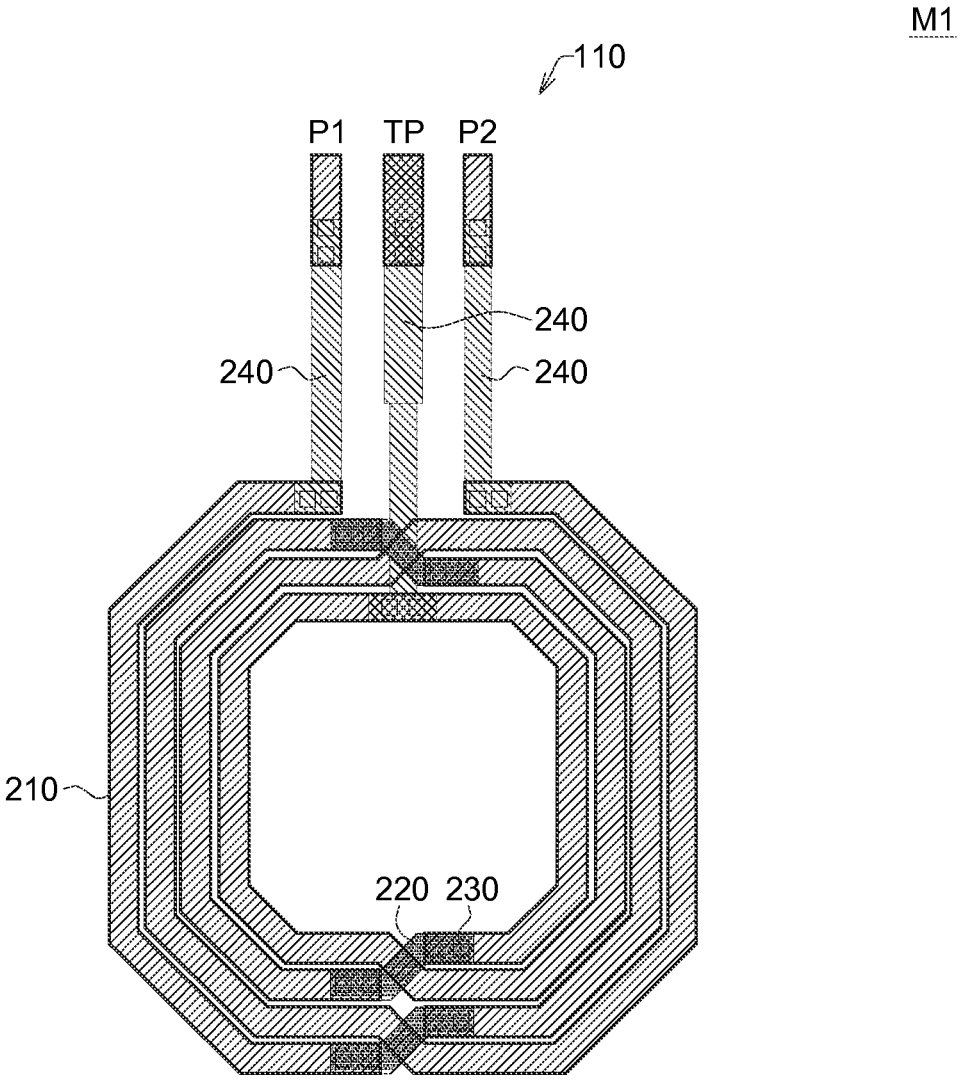
FIG. 2A shows a layout of a first winding conductor of the transformer according to an embodiment of the application.

FIG. 2A shows a layout of the first winding conductor 110 of the transformer 100 according to an embodiment of the application.

The first winding conductor 110 is electrically coupled to a first terminal (P1) and a second terminal (P2) of a first one of the corresponding input/output ports coupled to the transformer 100. The first winding conductor 110 is formed on the first metal layer M1. The first winding conductor 110 is routed in an inner part on the first metal layer M1 of the transformer 100. For example but not limited by, the first winding conductor 110 is routed in a center of the first metal layer M1 of the transformer 100.

The first winding conductor 110 includes a plurality of first sections 210 routed on the first metal layer M1, and a plurality of first interconnection sections 220 interconnecting the sections 210 through vias 230. The first interconnection sections 220 are formed on the second metal layer M2. Besides, a plurality of interconnection sections 240, formed on a third metal layer, are used to interconnect the first winding conductor 110 with the first terminal (P1) and the second terminal (P2) of the corresponding input/output port. The terminal TP is coupled to the first winding conductor 110 via the interconnection section 240. The terminal TP is a center tap of the balun and is connected to the supply voltage.

The first winding conductor 110 is magnetically coupled to the second winding conductor 120. In some embodiments of the application, the first winding conductor 110 is a primary winding of the transformer 100; while in other embodiments of the application, the first winding conductor 110 is a secondary winding of the transformer 100. Whether the first winding conductor 110 acts as the primary winding or the secondary winding depends on the signal flow direction. That is, if the corresponding port (having the terminals P1 and P2) coupled to the first winding conductor 110 is designed to receive a differential input signal, then the first winding conductor 110 acts as the primary winding. On the contrary, if the corresponding port (having the terminals P1 and P2) coupled to the first winding conductor 110 is designed to output a single-ended output signal, then the first winding conductor 110 acts as the secondary winding.

Figure 2B:
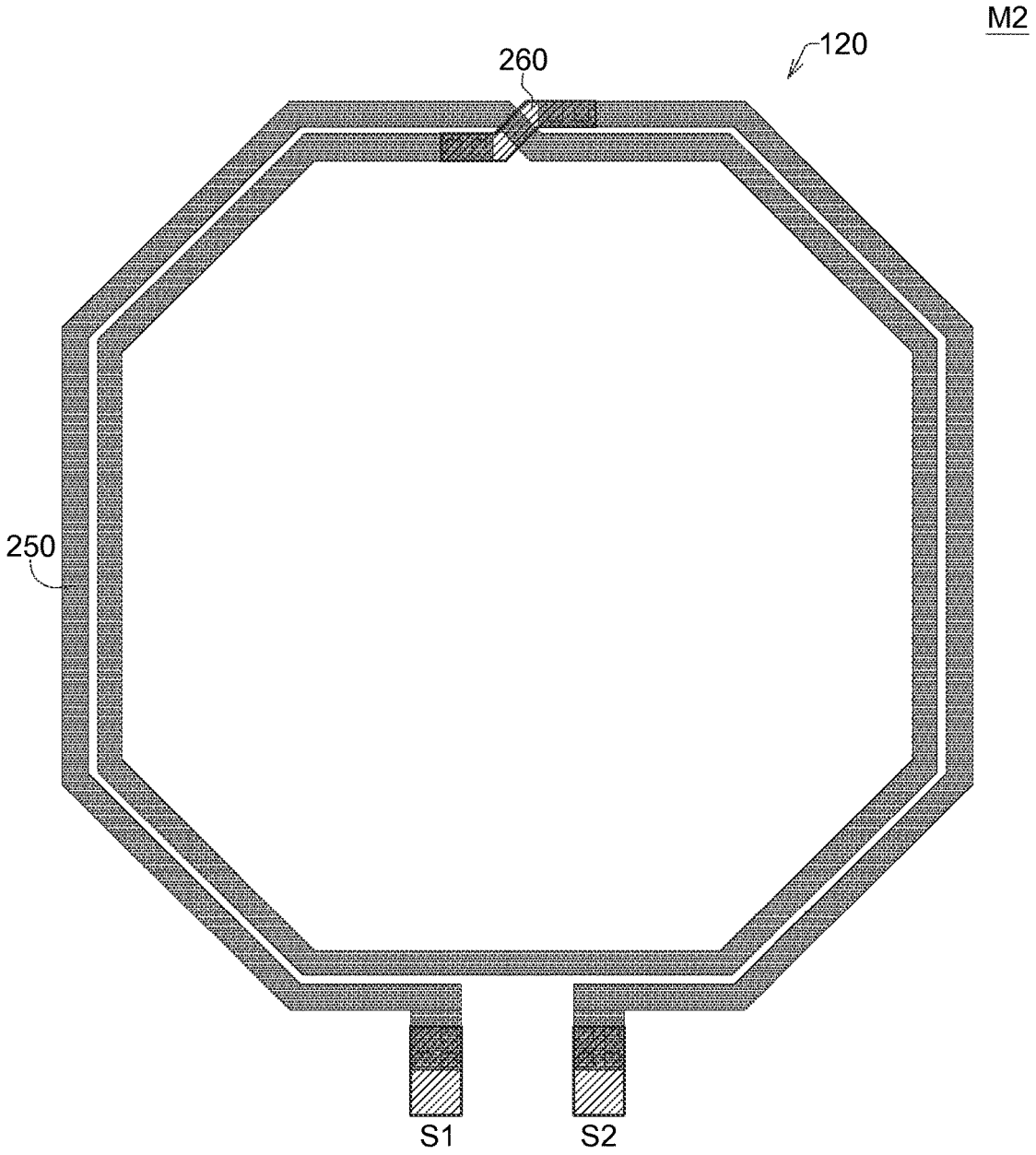
FIG. 2B shows a layout of a second winding conductor of the transformer according to an embodiment of the application.

FIG. 2B shows a layout of the second winding conductor 120 of the transformer 100 according to an embodiment of the application.

The second winding conductor 120 is electrically coupled to a first terminal (S1) and a second terminal (S2) of a second one of the corresponding input/output ports coupled to the transformer 100. The second winding conductor 120 is formed on the second metal layer M2. The second winding conductor 120 is routed in an outer part on the second metal layer M2 of the transformer 100.

Please note that the naming of the metal layers M1, M2 is not meant to limit the position relationship of the first and the second metal layers. For example, in one embodiment, the first metal layer M1 is configured to be disposed under the second metal layer M2; however, in another implementation, the first metal layer M1 could be alternatively disposed above the second metal layer M2. In short, the metal layers on which the winding conductors are routed depend upon design requirements. In addition, it should be noted that the layout design shown in the drawing is for illustrative purposes only, and is not meant to be a limitation of the present invention. That is to say, other alternative layout designs obeying the spirit of the present invention still fall within the scope of the present invention.

The second winding conductor 120 includes a plurality of second sections 250 routed on the second metal layer M2, and at least one second interconnection section 260 interconnecting the sections 250 through vias. The second interconnection section 260 is for example, but not limited by, formed on the first metal layer M1.

The second winding conductor 120 is magnetically coupled to the first winding conductor 110 and the third winding conductor 130. In some embodiments of the application, the second winding conductor 120 is a secondary winding of the transformer 100 (if the first winding conductor 110 is a primary winding of the transformer 100); while in other embodiments of the application, the second winding conductor 120 is a primary winding of the transformer 100 (if the first winding conductor 110 is a secondary winding of the transformer 100). Whether the second winding conductor 120 acts as the primary winding or the secondary winding depends on the signal flow direction. That is, if the corresponding port (having the terminals S1 and S2) coupled to the second winding conductor 120 is designed to output a single-ended output signal, then the second winding conductor 120 acts as the secondary winding. On the contrary, if the corresponding port (having the terminals S1 and S2) coupled to the second winding conductor 120 is designed to receive a differential input signal, then the second winding conductor 120 acts as the primary winding.

The second winding conductor 120 is vertically stacked with the third winding conductor 130. That is to say, in the embodiment of the application, the second winding conductor 120 is routed on the outer part of the second metal layer M2 and the third winding conductor 130 is routed on the outer part of the first metal layer M1. Besides, the second winding conductor 120 may be not precisely aligned with the third winding conductor 130.

Figure 2C:
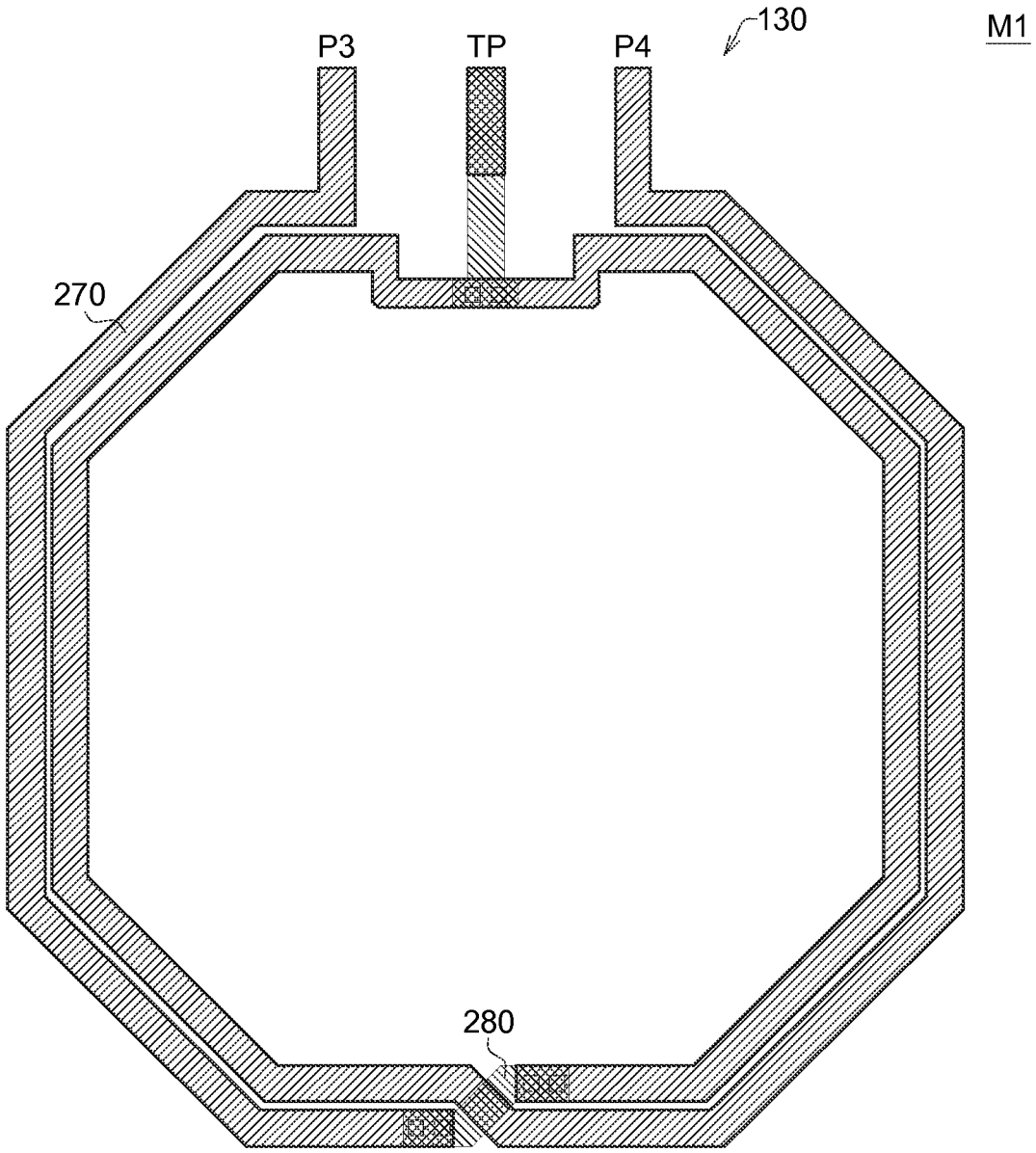
FIG. 2C shows a layout of a third winding conductor of the transformer according to an embodiment of the application.

FIG. 2C shows a layout of the third winding conductor 130 of the transformer 100 according to an embodiment of the application.

The third winding conductor 130 is electrically coupled to a first terminal (P3) and a second terminal (P4) of a third one of the corresponding input/output ports coupled to the transformer 100. The third winding conductor 130 is formed on the first metal layer M1. The third winding conductor 130 is routed in the outer part on the first metal layer M1 of the transformer 100. The third winding conductor 130 surrounds the first winding conductor 110.

The third winding conductor 130 includes a plurality of third sections 270 routed on the first metal layer M1, and at least one third interconnection section 280 interconnecting the sections 270 through vias. The third interconnection section 280 is formed on the third metal layer which is different from the first and the second metal layers M1 and M2.

The third winding conductor 130 is magnetically coupled to the second winding conductor 120. In some embodiments of the application, the third winding conductor 130 is a primary winding of the transformer 100 (if the second winding conductor 120 is a secondary winding of the transformer 100); while in other embodiments of the application, the third winding conductor 130 is a secondary winding of the transformer 100 (if the second winding conductor 120 is a primary winding of the transformer 100). Whether the third winding conductor 130 acts as the primary winding or the secondary winding depends on the signal flow direction. That is, if the corresponding port (having the terminals P3 and P4) coupled to the third winding conductor 130 is designed to receive a differential input signal, then the third winding conductor 130 acts as the primary winding. On the contrary, if the corresponding port (having the terminals P3 and P4) coupled to the third winding conductor 130 is designed to output a single-ended output signal, then the third winding conductor 130 acts as the secondary winding.

Figure 3A:
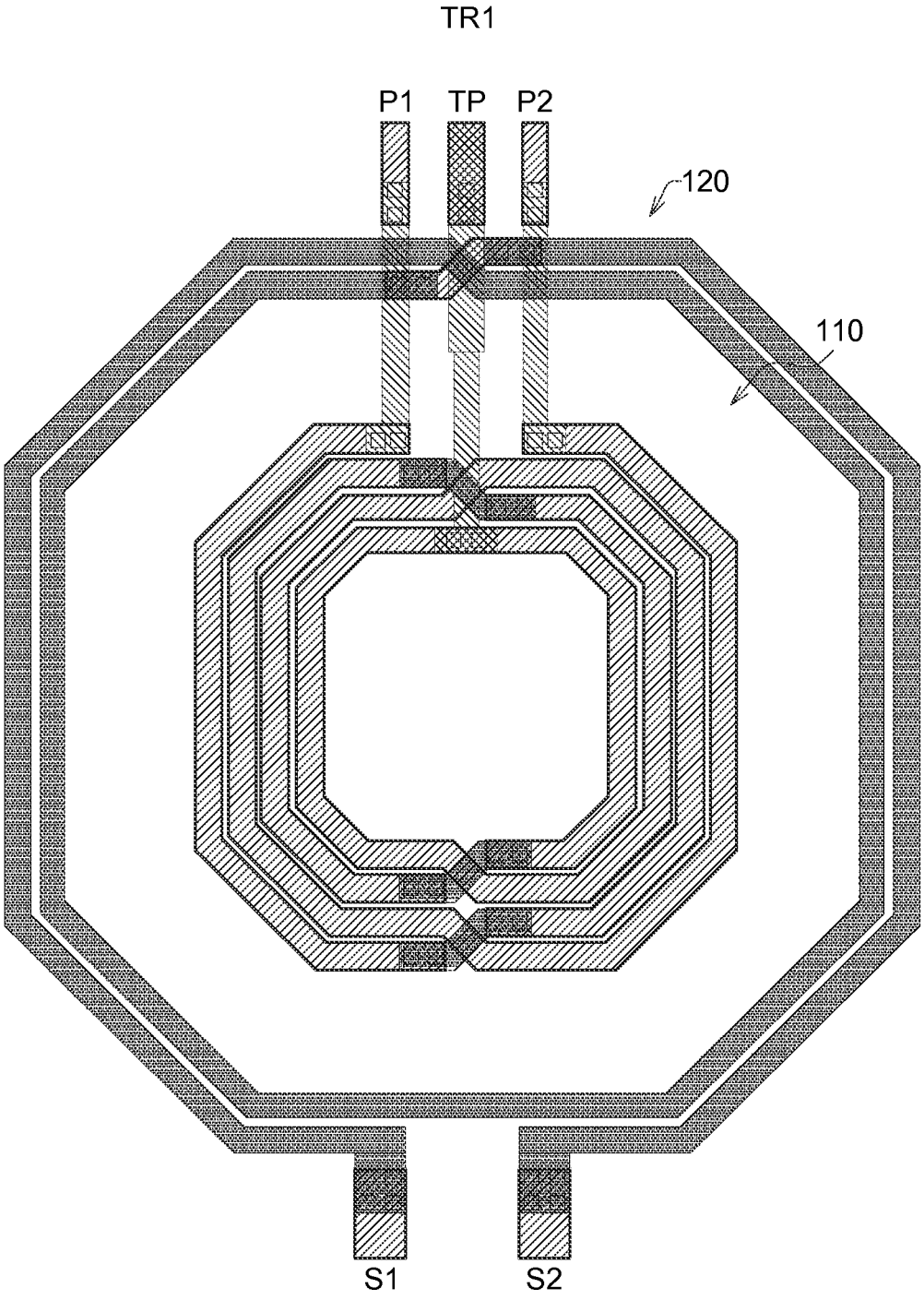
FIG. 3A shows the low coupling, high TR mode (achieved by the first winding conductor and the second winding conductor) of the transformer according to an embodiment of the application.
Figure 3B:
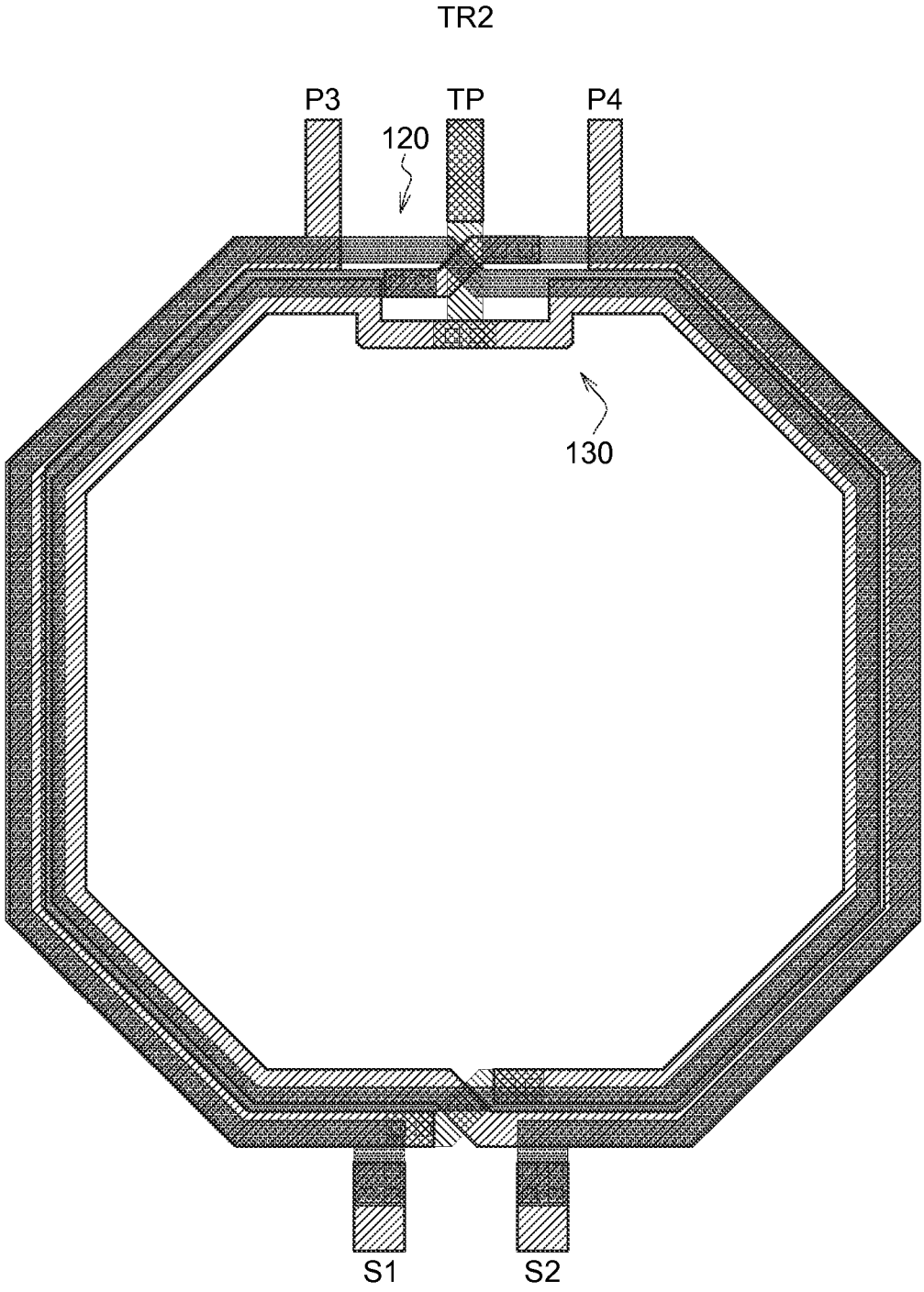
FIG. 3B shows the high coupling, low TR mode (achieved by the third winding conductor and the second winding conductor) of the transformer according to an embodiment of the application.

FIG. 3A shows the low coupling, high transformation ratio (TR) mode achieved by the first winding conductor 110 and the second winding conductor 120 of the transformer 100 according to an embodiment of the application. FIG. 3B shows the high coupling, low transformation ratio mode achieved by the third winding conductor 130 and the second winding conductor 120 of the transformer 100 according to an embodiment of the application.

The transformation ratio (TR) is expressed by the formula (1):

$$TR = n_{eq}^2 \tag{1}$$

The parameter "$n_{eq}$" refers to an equivalent turn ratio, which is expressed by the following formula (2):

$$n_{eq} = \frac{n}{k}\sqrt{1 + (1-k)^2\left(\frac{\omega L}{R_L}\right)^2} \simeq \frac{n}{k} \tag{2}$$

The parameter "n" refers to the turn ratio of the primary winding and the secondary winding, the parameter "k" refers to a coupling factor between the primary winding and the secondary winding, "L" refers to the inductance of the secondary winding, and "$R_L$" refers to the load resistance of the secondary winding. In the transformer 100, the small inductance L is used and thus the term "$(1-k)^2(\omega L/R_L)^2$" is very small.

In an embodiment of the application, the parameter "k" is related to the distance between the primary winding and the secondary winding. Further, if the distance between the primary winding and the secondary winding is far, then the parameter "k" is small.

The first winding conductor 110 and the second winding conductor 120 achieve a low coupling "k" because the distance between the first winding conductor 110 and the second winding conductor 120 is far. The third winding conductor 130 and the second winding conductor 120 achieve a high coupling "k" because the distance between the third winding conductor 130 and the second winding conductor 120 is close.

Further, an inductance of the first winding conductor 110 is bigger than both inductances of the second and the third winding conductors 120 and 130, and a surrounding area of the first winding conductor 110 is smaller than both surrounding areas of the second and third winding conductors 120 and 130. Further, a first transformation ratio is based on a first distance and an inductance ratio between the first and the second winding conductors 110 and 120. A second transformation ratio is based on a second distance and an inductance ratio between the third and the second winding conductors 130 and 120. The first transformation ratio is higher than the second transformation ratio.

For example, as shown in FIG. 3A, the first winding conductor 110 is the primary winding and the second winding conductor 120 is the secondary winding. Because the distance between the first winding conductor 110 and the second winding conductor 120 is far, the parameter "k" (k1) is very small. A small "k" results to a high $n_{eq}$ ($n_{eq1}$) and a high transformation ratio ($TR1=n_{eq1}^2$). For example, but not limited by, $n_{eq1}$ is higher than or equal to 1.5. In the embodiment of the application, the distance between the first winding conductor 110 and the second winding conductor 120 is higher than a distance threshold, and a first coupling factor between the first winding conductor 110 and the second winding conductor 120 is lower than a coupling factor threshold. The coupling factor threshold is for example but not limited by 0.6.

However, as shown in FIG. 3B, the third winding conductor 130 is the primary winding and the second winding conductor 120 is the secondary winding. Because the distance between the third winding conductor 130 and the second winding conductor 120 is much closer than the distance between the first winding conductor 110 and the second winding conductor 120, the parameter "k" (k2) in FIG. 3B is much higher than the parameter "k1" in FIG. 3A. A high "k" (k2) results to a low $n_{eq}$ ($n_{eq2}$) and a low transformation ratio ($TR2=n_{eq2}^2$). For example, but not limited by, the ratio ($n_{eq1}/n_{eq2}$) is higher than or equal to 1.5. In other words, the ratio (TR1/TR2) is higher than or equal to 2.25.

As shown in the drawing, the first winding conductor 110 leaves the metal space on the first metal layer M1 for the second input inductor to form the high transformation ratio mode. In other words, the first winding conductor 110 leaves the metal space on the first metal layer M1 for the third winding conductor 130. The first winding conductor 110 and the third winding conductor 130 are both routed on the first metal layer M1 for saving circuit areas.

In other words, in the embodiment of the application, the stacked transformer structure and the lateral transformer structure are used to achieve two largely different transformation ratios. The stacked transformer structure is achieved by the second winding conductor 120 (routed on the outer part of the second metal layer M2) and the third winding conductor 130 (routed on the outer part of the first metal layer M1) which are vertically stacked. The lateral transformer structure is achieved by the second winding conductor 120 (routed on the outer part of the second metal layer M2) and the first winding conductor 110 (routed on the inner part of the first metal layer M1) which are lateral, although the second winding conductor 120 and the first winding conductor 110 are routed on the different metal layers.

Now refer to FIG. 1 again. The first winding conductor 110 is coupled to the first port of the input/output ports. The second winding conductor 120 is coupled to the second port of the input/output ports. The third winding conductor 130 is coupled to the third port of the input/output ports. In some embodiments, only one of the first port and the third port may establish a signal path to the second port. The other port is isolated so that no signal flows on it. Thus, either the first port or the third port establishes a signal path to the second port, but not both.

As shown in FIG. 1 and FIG. 3A, when the transformer 100 is operated in the high transformation ratio (TR1) mode, the first port establishes a signal with the second port. The transformer 100 operated in the high transformation ratio (TR1) mode is suitable for example but not limited by, low output power condition.

As shown in FIG. 1 and FIG. 3B, when the transformer 100 is operated in the low transformation ratio (TR2) mode, the third port establishes a signal with the second port. The transformer 100 operated in the low transformation ratio (TR2) mode is suitable for example but not limited by, high output power condition.

The transformer 100 combines the features of the low coupling and the high coupling. When the input feeds into the first port coupled to the first winding conductor 110 (i.e. the first winding conductor 110 is as the primary winding), the transformer 100 operates in the low coupling, high TR mode which is suitable in low output power condition. When the input feeds into the third port coupled to the third winding conductor 130 (i.e. the third winding conductor 130 is as the primary winding), the transformer 100 operates in the high coupling, low TR mode which is suitable in high output power condition. Thus, the transformer 100 of the embodiment of the application may efficiently utilize available headroom at low output power to maximize power efficiency.

For example but not limited by, the transformer 100 of the embodiment of the application is suitable for being coupled to the PGA (programmable gain amplifier) of the RF transceiver design. Further, the transformer 100 of the embodiment of the application is suitable in RF circuit which meets two or more different output power requirements.

Further, by the low coupling, high transformation ratio mode of the transformer 100, the impedance transformation ratio is boosted. Because the low coupling "k" is used to realize the low coupling, high transformation ratio mode of the transformer 100, the de-Q effect on the high coupling, low transformation ratio mode is reduced. The circuit area is efficiently used because the metal layer space is left and available for the high coupling, low transformation ratio transformer structure.

It will be apparent to those skilled in the art that various modifications and variations can be made to the disclosed embodiments. It is intended that the specification and examples be considered as exemplary only, with a true scope of the disclosure being indicated by the following claims and their equivalents.

What is claimed is:

1. A transformer comprising:

a vertically stacked transformer structure, and a lateral transformer structure, wherein the lateral transformer structure includes a first winding conductor and a second winding conductor, the second winding conductor is magnetically coupled to the first winding conductor, the first winding conductor is routed on an inner part of a first metal layer and the second winding conductor is routed on an outer part of a second metal layer, and the vertically stacked transformer structure includes the second winding conductor and a third winding conductor, the third winding conductor is magnetically coupled to the second winding conductor, the third winding conductor is routed on an outer part of the first metal layer, a first transformation ratio is achieved between the second winding conductor and the first winding conductor; and a second transformation ratio is achieved between the second winding conductor and the third winding conductor.

2. The transformer according to claim 1, wherein the first transformation ratio has an equivalent turn ratio higher than or equal to 1.5;

the first transformation ratio is higher than the second transformation ratio; and the equivalent turn ratio of the first transformation ratio is higher than or equal to 1.5 times of an equivalent turn ratio of the second transformation ratio.

3. The transformer according to claim 1, wherein the second winding conductor is vertically stacked with the third winding conductor.

4. The transformer according to claim 1, wherein if the first winding conductor is as one of a primary winding and a secondary winding of the transformer, the second winding conductor is as the other of the primary winding and the secondary winding of the transformer.

5. The transformer according to claim 1, wherein if the third winding conductor is as one of a primary winding and a secondary winding of the transformer, the second winding conductor is as the other of the primary winding and the secondary winding of the transformer.

6. A transformer comprising:

a vertically stacked transformer structure, and a lateral transformer structure, wherein the lateral transformer structure includes a first winding conductor and a second winding conductor, the second winding conductor is magnetically coupled to the first winding conductor, the first winding conductor is routed on an inner part of a first metal layer and the second winding conductor is routed on an outer part of a second metal layer, and the vertically stacked transformer structure includes the second winding conductor and a third winding conductor, the third winding conductor is magnetically coupled to the second winding conductor, the third winding conductor is routed on an outer part of the first metal layer, the second winding conductor and the third winding conductor are vertically stacked, a first transformation ratio is based on a first distance and an inductance ratio between the first and the second winding conductors, a second transformation ratio is based on a second distance and an inductance ratio between the third and the second winding conductors, and the first transformation ratio is higher than the second transformation ratio.

7. The transformer according to claim 6, wherein if the first winding conductor is as one of a primary winding and a secondary winding of the transformer, the second winding conductor is as the other of the primary winding and the secondary winding of the transformer.

8. The transformer according to claim 6, wherein if the third winding conductor is as one of a primary winding and a secondary winding of the transformer, the second winding conductor is as the other of the primary winding and the secondary winding of the transformer.

9. The transformer according to claim 6, wherein the first transformation ratio has an equivalent turn ratio higher than or equal to 1.5; and the equivalent turn ratio of the first transformation ratio is higher than or equal to 1.5 times of an equivalent ratio of the second transformation ratio.

10. The transformer according to claim 6, wherein the first transformation ratio is used if at a first output power condition, and the second transformation ratio is used if at a second output power condition, the first output power condition lower than the second output power condition.

11. The transformer according to claim 6, wherein the first and the third winding conductors are lateral.

12. A transformer comprising:

a vertically stacked transformer structure, and a lateral transformer structure, wherein the lateral transformer structure includes a first winding conductor and a second winding conductor, the second winding conductor is magnetically coupled to the first winding conductor, the first winding conductor is routed on an inner part of a first metal layer and the second winding conductor is routed on an outer part of a second metal layer, and the vertically stacked transformer structure includes the second winding conductor and a third winding conductor, the third winding conductor is magnetically coupled to the second winding conductor, the third winding conductor is routed on an outer part of the first metal layer, if the first winding conductor is as any of a primary winding and a secondary winding of the transformer, the second winding conductor is as the other of the primary winding and the secondary winding of the transformer;

a first coupling factor is achieved between the first and the second winding conductors, and a second coupling factor, higher than the first coupling factor, is achieved between the second and the third winding conductors.

13. The transformer according to claim 12, wherein the second winding conductor is vertically stacked with the third winding conductor.

14. The transformer according to claim 12, wherein if the third winding conductor is as one of a primary winding and a secondary winding of the transformer, the second winding conductor is as the other of the primary winding and the secondary winding of the transformer.

15. A transformer comprising:

a vertically stacked transformer structure, and a lateral transformer structure, wherein the lateral transformer structure includes a first winding conductor and a second winding conductor, the second winding conductor is magnetically coupled to the first winding conductor, the first winding conductor is routed on an inner part of a first metal layer and the second winding conductor is routed on an outer part of a second metal layer, and the vertically stacked transformer structure includes the second winding conductor and a third winding conductor, the third winding conductor is magnetically coupled to the second winding conductor, the third winding conductor is routed on an outer part of the first metal layer, a first coupling factor and a first transformation ratio are achieved between the first and the second winding conductors, a second coupling factor and a second transformation ratio are achieved between the second and the third winding conductors, the first coupling factor lower than the second coupling factor, the first transformation ratio higher than the second transformation ratio, and an inductance of the first winding conductor is bigger than both inductances of the second and the third winding conductors, and a surrounding area of the first winding conductor is smaller than both surrounding areas of the second and the third winding conductors.

16. The transformer according to claim 15, wherein the second winding conductor is vertically stacked with the third winding conductor.

17. The transformer according to claim 15, wherein if the first winding conductor is as one of a primary winding and a secondary winding of the transformer, the second winding conductor is as the other of the primary winding and the secondary winding of the transformer.

18. The transformer according to claim 15, wherein if the third winding conductor is as one of a primary winding and a secondary winding of the transformer, the second winding conductor is as the other of the primary winding and the secondary winding of the transformer.

19. The transformer according to claim 15, wherein the first transformation ratio has an equivalent turn ratio higher than or equal to 1.5; and the equivalent turn ratio of the first transformation ratio is higher than or equal to 1.5 times of an equivalent turn ratio of the second transformation ratio.

20. The transformer according to claim 19, wherein the first transformation ratio is used if at a first output power condition, and the second transformation ratio is used if at a second output power condition, the first output power condition lower than the second output power condition.

21. A transformer comprising:

a vertically stacked transformer structure, and a lateral transformer structure, wherein the lateral transformer structure includes a first winding conductor and a second winding conductor, the second winding conductor is magnetically coupled to the first winding conductor, the first winding conductor is routed on an inner part of a first metal layer and the second winding conductor is routed on an outer part of a second metal layer, and the vertically stacked transformer structure includes the second winding conductor and a third winding conductor, the third winding conductor is magnetically coupled to the second winding conductor, the third winding conductor is routed on an outer part of the first metal layer, a first transformation ratio, achieved between the first and the second winding conductors, has an equivalent turn ratio higher than or equal to 1.5;

the first transformation ratio is higher than a second transformation ratio achieved between the second and the third winding conductors;

the equivalent turn ratio of the first transformation ratio is higher than or equal to 1.5 times of an equivalent turn ratio of the second transformation ratio;

a first coupling factor is achieved between the first and the second winding conductors, and a second coupling factor, higher than the first coupling factor, is achieved between the second and the third winding conductors.

22. A transformer comprising:

a vertically stacked transformer structure, and a lateral transformer structure, wherein the lateral transformer structure includes a first winding conductor and a second winding conductor, the second winding conductor is magnetically coupled to the first winding conductor, the first winding conductor is routed on an inner part of a first metal layer and the second winding conductor is routed on an outer part of a second metal layer, and the vertically stacked transformer structure includes the second winding conductor and a third winding conductor, the third winding conductor is magnetically coupled to the second winding conductor, the third winding conductor is routed on an outer part of the first metal layer, a first transformation ratio is achieved between the first and the second winding conductors;

a second transformation ratio is achieved between the second and the third winding conductors;

the first transformation ratio is used if at a first output power condition, and the second transformation ratio is used if at a second output power condition, the first output power condition lower than the second output power condition;

a first coupling factor is achieved between the first and the second winding conductors, and a second coupling factor, higher than the first coupling factor, is achieved between the second and the third winding conductors.

23. A transformer comprising:

a vertically stacked transformer structure, and a lateral transformer structure, wherein the lateral transformer structure includes a first winding conductor and a second winding conductor, the second winding conductor is magnetically coupled to the first winding conductor, the first winding conductor is routed on an inner part of a first metal layer and the second winding conductor is routed on an outer part of a second metal layer, and the vertically stacked transformer structure includes the second winding conductor and a third winding conductor, the third winding conductor is magnetically coupled to the second winding conductor, the third winding conductor is routed on an outer part of the first metal layer, a first transformation ratio is achieved between the second winding conductor and the first winding conductor;

a second transformation ratio, different from the first transformation ratio, is achieved between the second winding conductor and the third winding conductor;

the first transformation ratio is used if at a first output power condition, and the second transformation ratio is used if at a second output power condition, the first output power condition lower than the second output power condition.

* * * * *